US005699703A

United States Patent [19]

Habele

[11] Patent Number: 5,699,703

[45] Date of Patent: Dec. 23, 1997

[54] SCREWING DEVICE FOR MEASURING ARRANGEMENT

[75] Inventor: Michael Habele, Waldenbuch, Germany

[73] Assignee: Robert Bosch GmbH, Stuttgart, Germany

[21] Appl. No.: 605,814

[22] Filed: Feb. 22, 1996

[30] Foreign Application Priority Data

Mar. 3, 1995 [DE] Germany ..... 195 07 390.8

[51] Int. Cl.[6] ..... B25B 29/02

[52] U.S. Cl. ..... 81/57.38; 81/429; 73/761; 254/29 A

[58] Field of Search ..... 81/57.38, 177.85, 81/429; 73/761, 597, 862.381; 254/29 A

[56] References Cited

U.S. PATENT DOCUMENTS

| | | | |
|---|---|---|---|
| 3,969,960 | 7/1976 | Pagano | 81/429 |
| 4,899,591 | 2/1990 | Kibblewhite | 81/429 X |
| 5,226,327 | 7/1993 | Fassina | 81/429 X |
| 5,442,327 | 8/1995 | Ringer | 81/177.85 |

*Primary Examiner*—James G. Smith
*Attorney, Agent, or Firm*—Michael J. Striker

[57] ABSTRACT

A screwing device provides an ultrasound-controlled tensioning of a screw connection. A measurement of the pre-tensioning force of the screw connection can be performed without complete fitting of a screwing tool on the screw connection. The screwing tool for this purpose is displaceable axially within a certain limit relative to the rotary drive shaft. The screwing tool is pre-tensioned by a spring in direction toward the screw connection, so that a contact pin arranged centrally inside the screwing tool for electrical contacting of a vibration body is arranged always inside the screwing tool to be protected.

4 Claims, 3 Drawing Sheets

SCREWING DEVICE FOR MEASURING ARRANGEMENT

BACKGROUND OF THE INVENTION

The present invention relates to a screwing device for measuring arrangement.

A devices of the above mentioned general type are known in the art. One of such screwing devices is disclosed for example in the European patent document EP 467 262. In this screwing device a screwing tool is connected in a peripheral direction and axially fixedly with a rotary drive shaft of the screwing device. A measurement of a pre-tensioning force in the screwing connection after the ultrasonic wave-propagation time process is possible with this screwing device only when the screwing tool is fitted on the screw connection in an exact position, since only then a reliable contacting of the screwing connection via the conducting means is obtained. Before the measuring process, the screwing tool must be always completely fitted on the screw connection, which is very complicated. When the contacting means is formed so as to extend axially springy outwardly beyond the screwing tool, there is a danger that the sensitive contacting means can be damaged.

SUMMARY OF THE INVENTION

Accordingly, it is an object of the present invention to provide a screwing device of the above mentioned general type, which avoids the disadvantages of the prior art.

In keeping with these objects and with others which will become apparent hereinafter, one feature of the present invention resides, briefly stated, in a screwing device with ultrasonic measuring arrangement, which screwing device is provided with a rotary drive shaft for transmitting a torque to a screwing tool and contacting means for electrical signal transmission from an evaluating device to a swinging body arranged on the screwing connection and vice versa, wherein in accordance with the present invention the screwing tool is connected with the rotary drive shaft so that it is fixed in a peripheral direction and is displaceable axially within certain limits relative to the rotary drive shaft, and is loaded in direction toward the screw connection axially by a spring force.

When the screw device is designed in accordance with the present invention, a measurement of the pre-tensioning force is guaranteed also when the edges of the screw tool and the screw connection do not exactly coincide and therefore the screw tool is not completely fittable on the screw connection. It is also immaterial whether the screwing tool is formed for the inner engagement (for example a socket) or for the outer engagement (for example an outer hexagon). A reliable contacting of the measuring arrangement is guaranteed in every case. The contacting means are protected from damages.

In accordance with a further feature of the present invention, the screwing tool for an inner engagement is formed in a receiving opening on a head of a screw.

The screwing tool can be provided at the end with a ring projection for contacting the screw in the region of a base surface of the screw.

The screwing tool can be secured by securing elements axially on the tool receptacle and the securing elements can engage radially in longitudinal grooves in the rotary drive shaft.

The screwing tool can be secured relative to the tool receptacle by a bayonet connection, and a disc which is connected with the screwing tool axially and in a peripheral direction rotatably and displaceable can engage in a region of a reduced edge cross-section relative to the tool receptacle.

In this case for fixing the disc from rotation in the peripheral direction, at least one securing plate is provided which is engageable in an arresting opening arranged on an outer periphery of the screwing tool.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
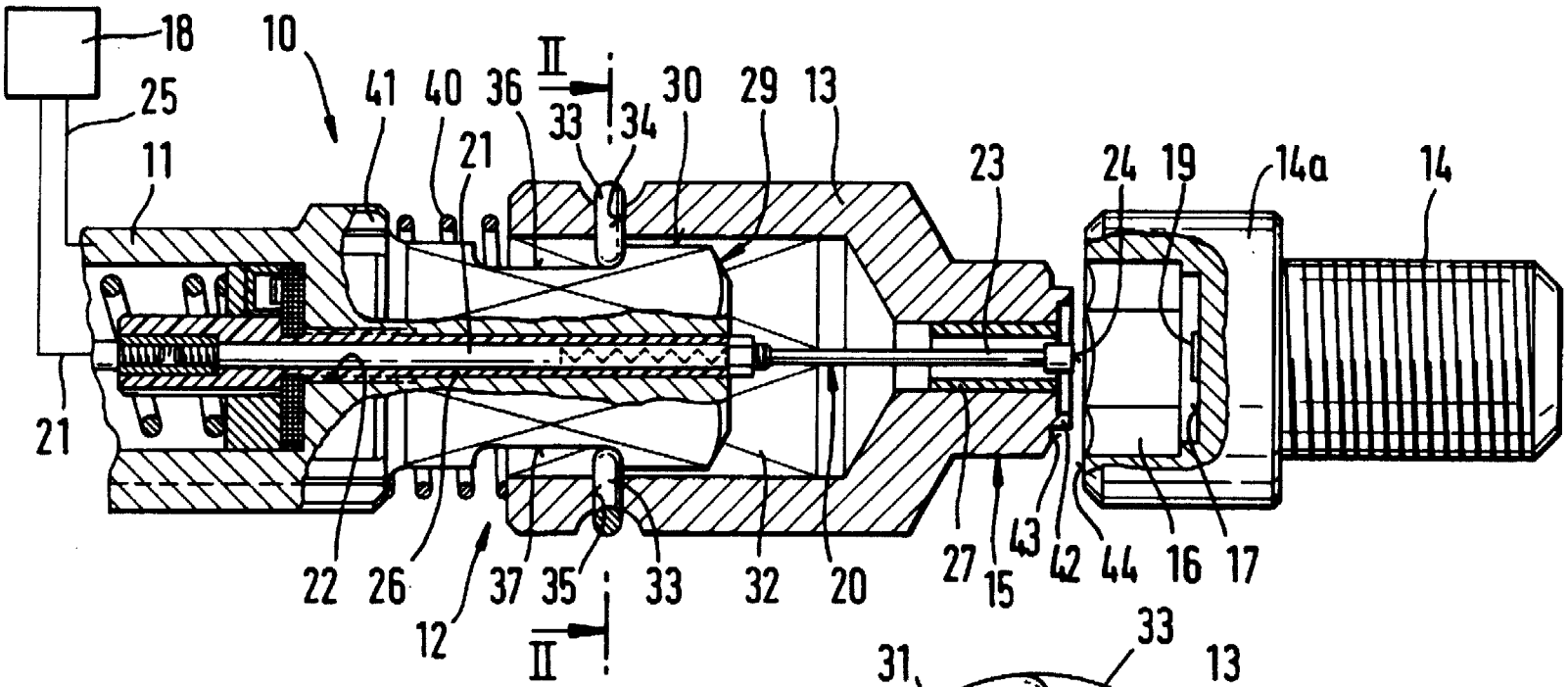
FIG. 1 is a view showing a longitudinal section of a screwing device in accordance with a first embodiment of the present invention.

FIG. 1 shows a front part of a screwing device in accordance with the present invention, located at a side of the screwing tool. The screwing device 10 has a rotary drive shaft 11 which is driven in rotation by a not shown drive motor. FIG. 1 shows an end of the rotary drive shaft 11 provided with a receptacle 12 for a screwing tool 13 for tensioning a screw connection. Only a screw 14 is shown for example as a part of the screw connection. The screwing device 10 can be also placed on a nut of the screw connection. The screwing tool 13 has an end 15 which faces the screw 14 and is offset and provided with an outer hexagon. The outer hexagon is formed for an inner engagement in a corresponding hexagonal receiving opening 16 in a head **14*a* of the screw 14**.

The screw 14 is provided on its head **14*a* with a vibration body 19, for example a piezo-crystal, which in response to corresponding electrical excitation produces high frequency acoustic vibrations and transmits into the screw connection. In a reverse order, the vibration body 19 receives echo vibrations from the screw connection and converts them into associated echo signals. By comparison of the excitation signals and the echo signals in a schematically shown evaluating device 18, it is possible to determine the stress condition in the screw connection and thereby the actual pre-tensioning force. The vibration body 19 is arranged for example centrally in a receiving opening 16 on a base surface 17**.

The screw connection 10 is provided with contacting means 20 for electrical signal transmission from the evaluating device 18 to the vibration body 19 and vice versa. The contacting means 20 include a transmission element 21 which axially extends mainly in the rotary drive shaft 11 in an axial opening 22. The transmission element 21 is composed of two parts at its end which faces the screwing tool and provided with an axially telescopably displaceable contact pin 23 loaded by a spring force in direction toward the screw 14. The transmission element 21 is hollow-cylindrical for receiving the contact pin 23. An abutment which is not shown in FIG. 1 prevents displacement of the contact pin 23 under the action of the spring force outwardly beyond the transmission element 21. In FIG. 1, the contact pin 23 is in its abutment position at the side of the screwing tool. A contact surface 24 is provided on the free tip of the contact pin 23 and serves for contacting the vibration body 19. A transmission element 21 and the contact pin 23 are electrically insulated from the rotary drive shaft 11 and the screwing tool 13 by insulating means 26, 27.

Figure 2:
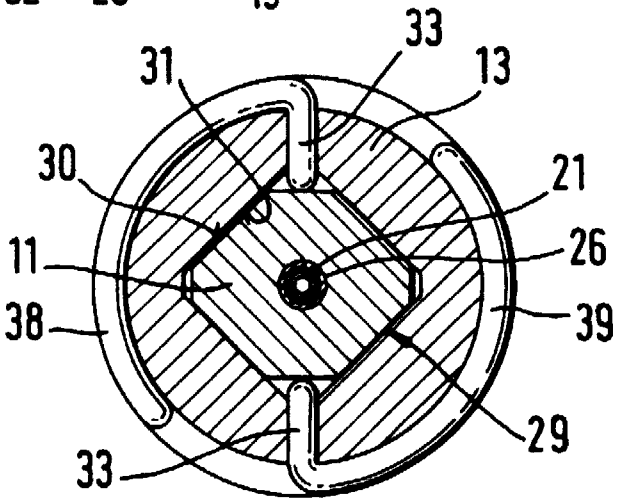
FIG. 2 is a view showing a section taken along the line II—II in FIG. 1.
Figure 3:
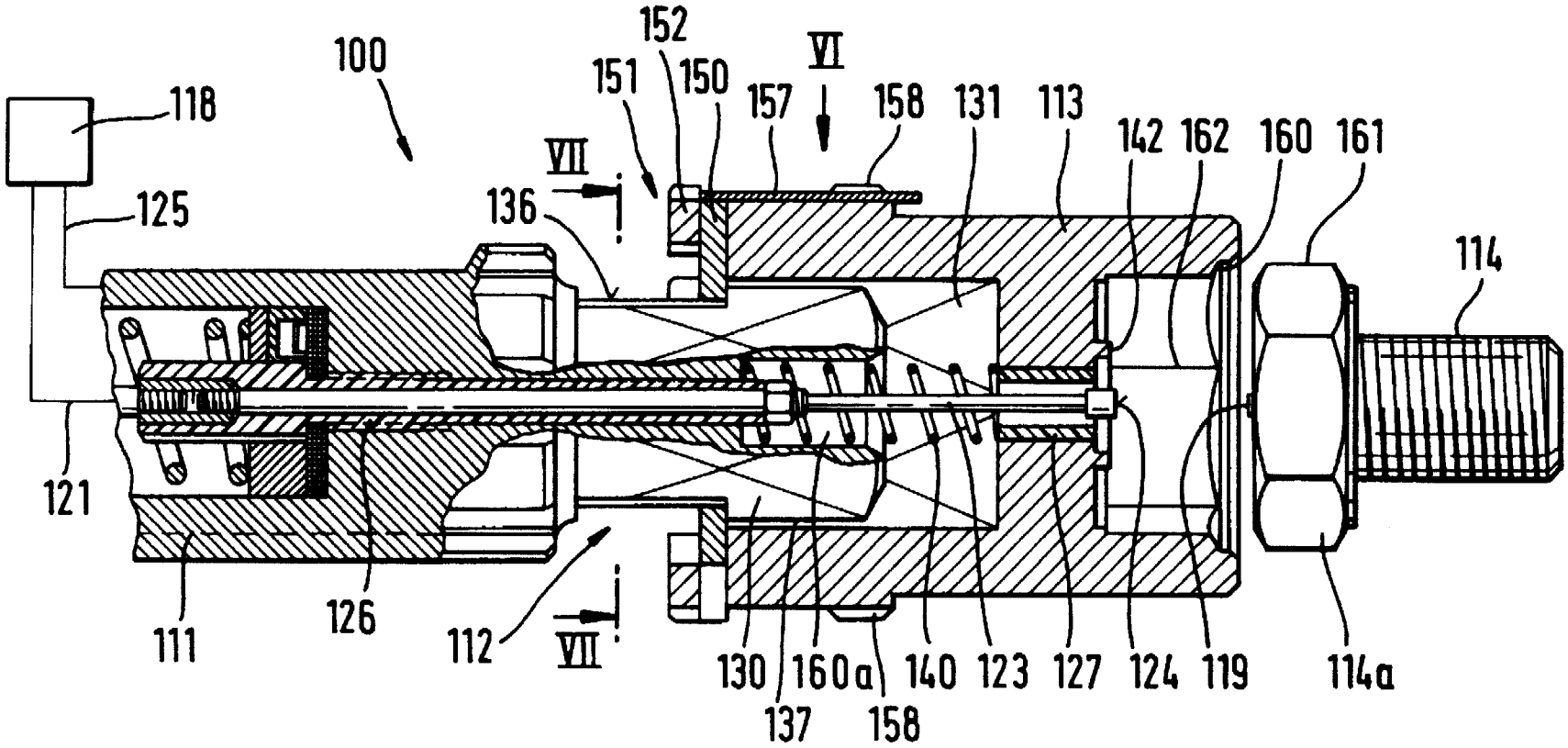
FIG. 3 is a view showing a longitudinal section of a screwing device in accordance with a second embodiment of the invention.

The current circuit from the evaluating device 18 to the vibration body 19 is closed through a ground connection 25. The ground connection is performed through the rotary drive shaft 11, the screwing tool 13 and the screw 14 to the vibration body 19 which is electrically conductive. On the other hand, a separate insulated conductor can be provided as a ground connection. The rotary drive shaft 11 and the screwing tool 13 are connected with one another through a polygonal profile 29 so that they rotate together. As can be seen from FIG. 2, the polygonal profile 29 is formed as a square profile. The tool receptacle 12 is formed therefore as an outer square 30 which partially engages into a corresponding opening 32 provided in the screwing tool 13 and formed as an inner square 31. The screwing tool 13 is axially secured on the tool receptacle 12 by two securing elements 33. The securing elements engage with a pin-like end radially through openings 34, 35 in the screw tool 13 into longitudinal grooves 36, 37 in the tool receptacle 12. Securing elements 32 are provided with clamping brackets 38, 39. The clamping brackets are ring-shaped and extend over more than a quarter circle and less than a half circle. They are composed of springy yieldable material. The clamping brackets 38, 39 are located on the outer periphery of the screwing tool 13. After spreading of the clamping brackets 38, 39 radially outwardly, the securing elements 33 are removable from the screwing tool 13.

The screwing tool 13 is loaded with a force of a spring 40 in direction of the screw 14. The spring 40 supports at the one end against a collar 41 of the rotary drive shaft 11 and at the other end against the screwing tool 13. At the end 15 of the screwing tool 13 which faces the screw 14, a ring projection 42 is provided. It assures a disturbance-free contacting between the screwing tool 13 and the screw 14 in the region of the base surface 17.

The contacting of the vibration body 19 during setting of the screwing tool 13 is performed in the following manner:

When a measurement of the pre-tensioning force in the screw connection is desired, the rotary drive shaft 11 is moved from the position shown in FIG. 1 coaxially toward the screw 14 until the end side 43 of the screwing tool 13 abuts against the screw 14. The position of the edges of the screwing tool 13 and the receiving opening 16 relative to one another is immaterial. When the edges are in alignment in the axial direction, the screwing tool 13 comes to abutment with its end side 43 against a head surface 44 of the screw 14, and the electrical mass contact between the screwing tool 13 and the screw 14 is closed. Because of the longitudinal grooves 36, 37, the screwing tool 13 is axially displaceable relative to the rotary drive shaft 11 against the spring force 40, so that the rotary drive shaft 11 is displaced further to the screw 14 until the contact pin 23 contacts with the vibration body 19. The rotary drive shaft 11 can be at least displaced so far until the contact pin 23 is sprung into the transmission element 21. In this position the vibration body 19 is completely electrically contacted so that the measurement of the pre-tensioning force can be performed by the ultrasound measuring arrangement. When the screw connection 14 must be tensioned on or released via the screw device 10, the edges of the screwing tool 13 and the receiving opening 16 are brought flush with one another. The screwing tool 13 can therefore engage in the receiving opening 16, so that the ring projection 42 comes to abutment against the base surface 17. The pre-tensioning force can be measured during the tensioning or releasing of the screw connection.

In the second embodiment shown in FIGS. 3 to 7, the same or identically operating parts are identified similar to the parts of the first embodiment but with reference numerals increased by 100. The main difference between the first and second embodiment is the way the axial fixation of the screwing tool 13, 113 is performed relative to the tool receptacle 12, 112 as well as the design of the screwing tool 13, 113. Analogously to the first embodiment, a transmission element 121 axially extends through the rotary drive shaft 111, and a telescopical springy contact pin 123 is arranged on its end. The transmission element 121 and the contact pin 123 are electrically insulated from the rotary drive shaft 111 or the screwing tool 113 by insulating means 126, 127. The vibration body 19 is connected on the head **114*a* of the screw 114 electrically conductively with the evaluating device 118 through the contact surface 124 of the contact pin 123. The current circuit is closed through the ground connection 125** in correspondence with the first embodiment.

The tool receptacle 112 is also formed as an outer square 130, which engages in a corresponding inner square receptacle 131 of the screwing tool 113 when the screwing tool 113 is fitted on. The axial securing of the screwing tool 113 relative to the rotary drive shaft 111 is provided in a region 136 with an edge cross-section of the outer square 130 which is reduced relative to the tool receptacle 112. A disc 150 is connected by a bayonet connection 151 with the screwing tool 113 on the end side facing the rotary drive shaft 111. Several undercuts 152 are distributed over the periphery on the screwing tool 113 for this purpose, and the disc 150 is engageable in them.

Figure 4:
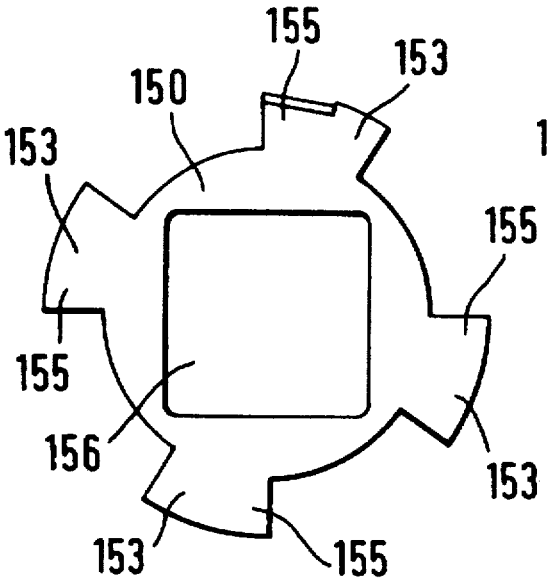
FIG. 4 is a view showing a holding disc of the inventive screwing device.
Figure 5:
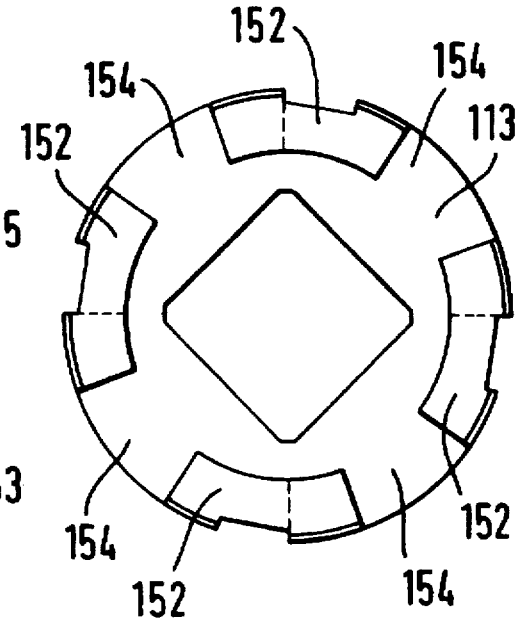
FIG. 5 is a view showing a screwing tool of the inventive screwing device.
Figure 6:
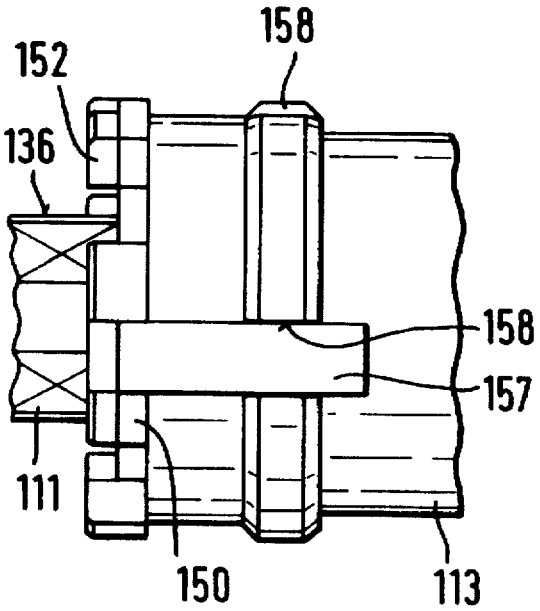
FIG. 6 is a view showing a partial section of the screwing device as seen in direction of the arrow VI in FIG. 3.
Figure 7:
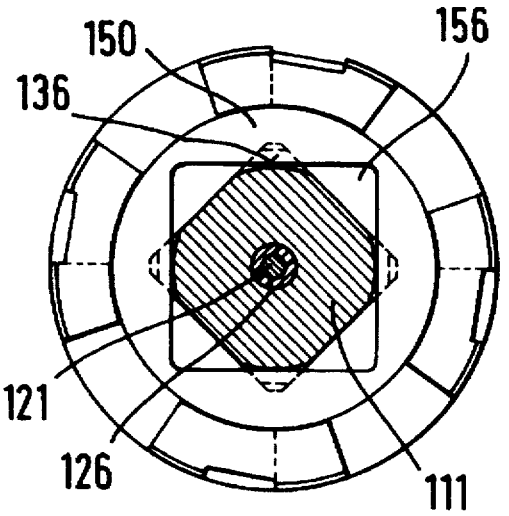
FIG. 7 is a view showing a cross-section taken along the line VII—VII in FIG. 3.

FIG. 4 shows a front view of the disc 150, while FIG. 5 shows a front view of the screwing tool 113 at the end side which faces the rotary drive. Four vanes 153 are arranged on the disc 150 on its periphery and spaced from one another. In the shown rotary position of the disc 150 and the screwing tool 113 they are axially insertable in associated recesses 154. By subsequent turning of the disc 150 relative to the screwing tool 13 in counterclockwise direction, the arresting projections 152 engage in a coinciding region 155 of the vanes 153 so that the screwing tool 113 is axially fixed within the range of the region 136 on the tool receptacle 112. The disc 130 has a throughgoing opening 156 formed so that it is movable over the outer polygon 130 and in the region 136 with a reduced edge cross-section of the longitudinal grooves 136, 137 is turnable relative to the rotary drive shaft 111. The throughgoing opening 156 of the disc 150 is shown in FIG. 7. The edges 137 of the outer polygon 130 are rounded in the region 136. In the shown rotary position of the disc 150, the screwing tool 136 is axially limited by the edges 137 of the polygonal profile 29. The disc 150 is secured by a securing plate 157 shown in FIG. 6 from rotation in the peripheral direction. In the secured position the securing plate 157 springily engages in arresting depressions 158 on the outer periphery of the screwing tool 113.

The screwing tool 113 in the second embodiment is pre-tensioned by a spring 140 in direction of the screw 114. The spring 140 is partially introduced in a blind hole 160 on the end 150 of the rotary drive shaft 111 and abuts against the rotary drive shaft 111.

During axial displacement of the rotary drive shaft 111 onto the screw 114, the screwing tool 113 is seated first on the screw head 114*a*. For providing in each case a reliable mass contact a ring recess 160 is arranged at the end in the screwing tool 113 and its diameter exceeds the edge size of the screw 114. If the edges 161, 162 of the screwing tool 113 and the screw head 114*a* are not in alignment with one another, then during further movement of the rotary drive shaft 111 the screwing tool 113 is axially displaced against the force of the spring 140 until the contact pin 123 contacts with the contact surface 124 of the vibration body 119. When the edges 161, 162 to the contrary, coincide with one another, the screwing tool 113 engages the screw head 114*a*. A ring projection 142 can be provided inside the receiving opening, which improves the mass contacting additionally when the screwing tool 113 is fitted on the screw head 114*a*. Due to the axial displaceability of the screwing tool 113, a measurement of the pre-tensioning force of the screw connection is also possible without placing the screwing tool 113 in a position on the screw head 114*a*.

It will be understood that each of the elements described above, or two or more together, may also find a useful application in other types of constructions differing from the types described above.

While the invention has been illustrated and described as embodied in a screwing device for measuring arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A screwing device with ultrasonic measuring arrangement for measuring a tension in a screw connection with a vibration body arranged on it, the screwing device comprising a screwing tool; a rotary drive shaft for transmitting a torque to said screwing tool; an evaluating device; contacting means for electrical signal transmission from said evaluation device to said vibration body and vice versa, said screwing tool being connected with said rotary drive shaft so that said screwing tool is fixed to said rotary drive shaft in a peripheral direction and is axially displaceable relative to said rotary drive shaft within a limit in an axial direction, said screwing tool being loaded axially with a spring force toward said screw connection.

2. A screwing device as defined in claim 1; and further comprising means forming a tool receptacle; and securing elements securing said screwing tool axially on said tool receptacle, said rotary drive shaft being provided with a longitudinal groove in which said securing elements radially engage.

3. A screwing device as defined in claim 1; and further comprising means forming a tool receptacle, said screwing tool being axially secured relative to said tool receptacle by a bayonet connection; a disc which is connectable with said screwing tool axially and rotatable and displaceably in a peripheral direction; and a region with an edge cross-section which is reduced relative to said tool receptacle and in which said disc engages.

4. A screwing device as defined in claim 3; and further comprising at least one securing plate which fixes said disc from rotation in a circumferential direction, said screwing tool having an outer periphery provided with an arresting depression in which said securing plate is engageable.

* * * * *